US012553621B2

(12) United States Patent
Kim et al.

(10) Patent No.: US 12,553,621 B2
(45) Date of Patent: Feb. 17, 2026

(54) FAN, AIR CONDITIONER HAVING FAN, AND MANUFACTURING METHOD OF FAN

(71) Applicant: SAMSUNG ELECTRONICS CO., LTD., Suwon-si (KR)

(72) Inventors: Byungghun Kim, Suwon-si (KR); Hyunggeun Park, Suwon-si (KR); Hwansoo Lee, Suwon-si (KR); Inwon Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 270 days.

(21) Appl. No.: 18/118,535

(22) Filed: Mar. 7, 2023

(65) Prior Publication Data

US 2023/0204229 A1 Jun. 29, 2023

Related U.S. Application Data

(63) Continuation of application No. PCT/KR2021/009075, filed on Jul. 15, 2021.

(30) Foreign Application Priority Data

Sep. 9, 2020 (KR) ..... 10-2020-0115641

(51) Int. Cl.
*F24F 1/0287* (2019.01)
*F24F 1/0323* (2019.01)

(52) U.S. Cl.
CPC ..... *F24F 1/0287* (2019.02); *F24F 1/0323* (2019.02)

(58) Field of Classification Search
CPC ..... F24F 1/0287; F24F 1/0047; F24F 1/0022; F04D 29/28; F04D 29/4226; B29L 2031/08; B29C 33/30
USPC ..... 165/122
See application file for complete search history.

(56) References Cited

U.S. PATENT DOCUMENTS 8,007,240 B2 8/2011 Sanagi et al.
8,784,060 B2 7/2014 Iwata et al.
8,834,121 B2 * 9/2014 Ikeda ..... F04D 25/088 416/243
9,651,056 B2 5/2017 Ikeda et al.
9,951,782 B2 4/2018 Kurihara et al.
(Continued)

FOREIGN PATENT DOCUMENTS

CN 106762819 B 5/2019
CN 109538528 B 12/2019
(Continued)

OTHER PUBLICATIONS

International Search Report dated Oct. 29, 2021 issued in PCT Application No. PCT/KR2021/009075.
(Continued)

*Primary Examiner* — Steve S Tanenbaum
(74) *Attorney, Agent, or Firm* — STAAS & HALSEY LLP

(57) ABSTRACT

A fan comprises a base to be rotated with respect to a rotation axis, an inlet having an opening formed in a center thereof, the inlet spaced apart from the base with respect to a rotation axis direction, and a blade arranged between the base and the inlet. The blade comprises a first surface facing outward with respect to a radial direction of the fan, a second surface facing inward with respect to the radial direction of the fan, and a curved portion protruding from the first surface.

13 Claims, 19 Drawing Sheets

(56) References Cited

U.S. PATENT DOCUMENTS

| | | | | |
|---|---|---|---|---|
| 9,989,073 | B2 | 6/2018 | Hwang et al. | |
| 10,641,280 | B2 | 5/2020 | Sato | |
| 10,662,968 | B2 | 5/2020 | Son et al. | |
| 11,150,060 | B2 | 10/2021 | Hartl et al. | |
| 2018/0283395 | A1* | 10/2018 | Sato | F24F 1/0022 |

FOREIGN PATENT DOCUMENTS

| | | | |
|---|---|---|---|
| EP | 1 933 040 | A1 | 6/2008 |
| EP | 2 264 320 | B1 | 8/2018 |
| EP | 3 034 885 | B1 | 1/2020 |
| EP | 3 093 499 | B1 | 6/2020 |
| JP | 2008-002379 | | 1/2008 |
| JP | 4432474 | | 3/2010 |
| JP | 2013-117233 | | 6/2013 |
| JP | 5283691 | | 9/2013 |
| JP | 5425270 | | 2/2014 |
| JP | 5988776 | | 9/2016 |
| JP | 6690629 | | 4/2020 |
| KR | 10-0738702 | | 7/2007 |
| KR | 10-1210696 | | 12/2012 |
| KR | 10-2016-137117 | | 11/2016 |
| KR | 10-1677030 | | 11/2016 |
| KR | 10-1720491 | | 3/2017 |
| KR | 10-1764430 | | 8/2017 |
| KR | 10-2018-0130336 | | 12/2018 |
| KR | 10-2124929 | | 6/2020 |

OTHER PUBLICATIONS

Written Opinion dated Oct. 29, 2021 issued in PCT Application No. PCT/KR2021/009075.

Office Action dated Jun. 20, 2025 issued in Korea Application No. 10-2020-0115641.

* cited by examiner

FAN, AIR CONDITIONER HAVING FAN, AND MANUFACTURING METHOD OF FAN

CROSS-REFERENCE TO RELATED APPLICATION

This application is a continuation application, under 35 U.S.C. § 111 (a), of International Application No. PCT/KR2021/009075, filed on Jul. 15, 2021, which is based on and claims priority under 35 U.S.C. § 119 to Korean Patent Application No. 10-2020-0115641, filed on Sep. 9, 2020 in the Korean Intellectual Property Office, the disclosures of which are incorporated by reference herein in their entirety.

BACKGROUND

Field

The present disclosure relates to an air conditioner, and more particularly to a fan of the air conditioner.

Description of the Related Art

In general, a fan is a device that blows air by a rotational force and is used in refrigerators, air conditioners, vacuum cleaners, and the like. The fan may be classified into axial fans and centrifugal fans according to air suction and discharge methods and their shapes.

Meanwhile, various filters may be arranged in the air conditioner. Because the filters impede air flow of the air conditioner, a centrifugal fan configured to generate higher static pressure than other types of fans is applied to the air conditioner.

The centrifugal fan is a fan that forcibly blows fluid, which is introduced in the axial direction, in the radial direction by the rotation of blades. In general, the centrifugal fan includes a base on which a fan motor is installed, a plurality of blades arranged at regular intervals between the base and an inlet member, and an inlet forming the inlet member. An outlet of the centrifugal fan may be formed along the circumference of the centrifugal fan between the base and the inlet member.

As the fan motor drives the centrifugal fan with the above-mentioned configuration, air is introduced through the inlet along the rotation axis direction, and the introduced air is discharged through the outlet between the plurality of blades.

SUMMARY

One aspect of the present disclosure provides a fan including a base to be rotated with respect to a rotation axis, an inlet having an opening formed in a center thereof, the inlet spaced apart from the base with respect to a rotation axis direction, and a blade arranged between the base and the inlet. The blade includes a first surface facing outward with respect to a radial direction of the fan, a second surface facing inward with respect to the radial direction of the fan, and a curved portion protruding from the first surface.

The blade may further include a hollow formed inside the blade.

The hollow may include a first opening formed on an outer surface of the base and arranged at one end of the hollow, and a second opening formed on an outer surface of the inlet and formed at an other end of the hollow.

One end of the first opening may be arranged on an outside of the outer surface of the base, an other end of the first opening may be arranged on an inside of the outer surface of the base, and the one end of the first opening may be to follow the other end of the first opening with respect to a rotation direction of the base. The second opening may overlap the inside of the first opening at one end of the first opening when viewed from the outer surface of the base.

A portion of the hollow may be a guide hollow arranged parallel to the rotation axis and extending from the second opening toward the one end of the first opening.

The guide hollow may have a flat bar shape extending from the first opening toward one end of the second opening.

The guide hollow may be arranged in a region, which corresponds to the curved portion, of the inside of the blade.

An area of a cross section of the hollow perpendicular to the rotation axis may be gradually reduced from the first opening to the second opening.

A cross section of the hollow adjacent to the first opening and perpendicular to the rotation axis may have a shape corresponding to a shape of a cross section of the blade adjacent to the first opening and perpendicular to the rotation axis.

The blade, the hollow and the first opening may be provided in plurality.

The fan may further include a groove formed on the outer surface of the base and formed between two adjacent first openings among a plurality of first openings.

The groove may extend from one end of one first opening of the two adjacent first openings toward the other end of the other first opening, and be arranged not to overlap the first opening with respect to the radial direction.

The blade may be formed among connection lines connecting one end and the other end of a cross section of the blade perpendicular to the rotation axis, a first connection line adjacent to the base is inclined to a first direction, which is opposite to the rotation direction of the base, with respect to a second connection line adjacent to the inlet.

A second direction corresponding to a protruding direction of the curved portion may be in a direction opposite to the first direction.

Another aspect of the present disclosure provides an air conditioner including a housing, a heat exchanger arranged inside the housing, and a fan configured to introduce external air into the housing and discharge the introduced air to an outside of the housing. The fan includes an inlet having an opening through which the external air is introduced, a base on which a fan motor configured to rotate the fan is mounted, and a blade arranged between the base and the inlet, the blade including a first surface member facing outward with respect to a radial direction of the fan, and a second surface facing inward with respect to the radial direction, and a curved portion protruding from the first surface.

The blade may further include a hollow formed inside the blade and the hollow may include a first opening formed on an outer surface of the base and arranged at one end of the hollow, and a second opening formed on an outer surface of the inlet and formed at the other end of the hollow. The second opening and one side of the hollow may be arranged in a region corresponding to the curved portion.

Another aspect of the present disclosure provides a manufacturing method of a fan, the manufacturing method including forming a molding space, into which a resin is injected, by coupling a first mold forming an upper surface of a base, a second mold forming a first surface of a blade, a third mold forming a lower surface of an inlet through which air is introduced, and a fourth mold forming a second surface of the blade and an upper surface of the inlet, inserting a cavity core, which protrudes from the first mold, into the molding space so as to form the hollow, and injecting a resin to the molding space, in a state in which one end of the cavity core is fixed to the third mold, thereby injection-molding the fan.

The blade may be formed by injecting a resin to the molding space and a vicinity of the cavity core. A first opening formed on the upper surface of the base and arranged on end of the hollow may be injection-molded by injecting the resin to a vicinity of a portion, which is adjacent to the first mold, of the cavity core. A second opening formed on the lower surface of the inlet and formed on the other end of the hollow may be injection molded by injecting the resin to a vicinity of one end of the cavity core fixed to the third mold.

In order to allow the blade to include a first surface located in a rotation direction of the base, a second surface located in a direction opposite to the rotation direction of the base, and a curved portion protruding from the first surface, the fourth mold may include a depression formed at a position corresponding to the cavity core based on the first mold to the fourth mold being coupled to each other, and the curved portion may be injection molded by injecting a resin between the cavity core and the depression.

The resin may be injected to the molding space from a side of the first mold to allow the resin to spread from an inside of the upper surface of the base to an outside of the upper surface of the base. The first mold may include a protrusion formed on the first mold, and a groove may be injection molded on a lower surface of the base by the protrusion provided in plurality and formed between two adjacent cavity cores among the plurality of cavity cores so as to limit a flow of the resin.

The first mold may further include a bearing fixer provided at a center of the first mold. The second mold may include a plurality of support protrusions provided at positions corresponding to the bearing fixer of the first mold so as to support bearings. The fan may be injection molded by inserting the bearing to the center of the base in a state in which the bearing is supported by the plurality of support protrusions by coupling the first mold to the fourth mold after the bearing is inserted into the bearing fixer.

DETAILED DESCRIPTION

Figure 1:
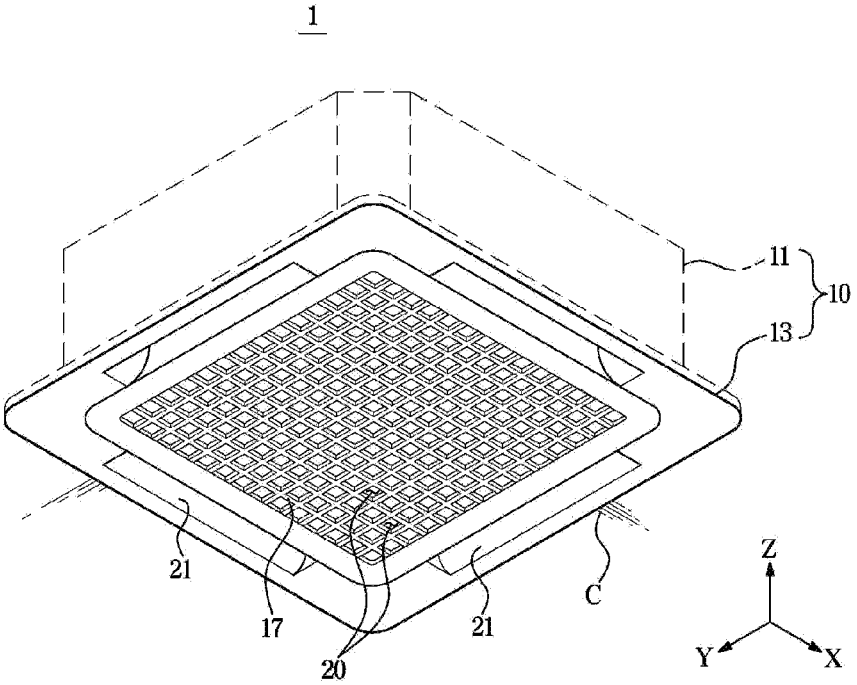
FIG. 1 is a view of an air conditioner according to one embodiment of the present disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function. Shapes and sizes of elements in the drawings may be exaggerated for clear description.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "upper portion", "lower portion", "upper end", "lower end", "upper surface", "lower surface", and the like may be defined based on FIG. 2, but the shape and the location of the component is not limited by the term.

In addition, a fan described below is applied to a ceiling-type air conditioner as an example, but may also be applied to other types of air conditioners such as a stand-type air conditioner or a wall-mounted air conditioner, and other home appliances such as a refrigerator or a vacuum cleaner.

The disclosure will be described more fully hereinafter with reference to the accompanying drawings.

The present disclosure is directed to providing a fan capable of having an improved performance, an air conditioner including the fan, and a manufacturing method of the fan.

Because a fan is molded integrally, a point at which energy loss occurs may be reduced in comparison with a state in which each component is separately produced and manufactured, and thus a performance of the fan may be improved.

A manufacturing method of a fan may allow a core forming a hollow inside a blade to be supported at both ends of the core and then inject a resin at high pressure, thereby preventing core damage and improving durability of a manufacturing apparatus.

A manufacturing method of a fan may limit a flow of a resin in a specific region, thereby reducing molding defects of the fan caused by air being trapped in the specific region.

FIG. 1 is a perspective view of an air conditioner according to one embodiment of the present disclosure. FIG. 2 is a side cross-sectional view of the air conditioner shown in FIG. 1.

Figure 2:
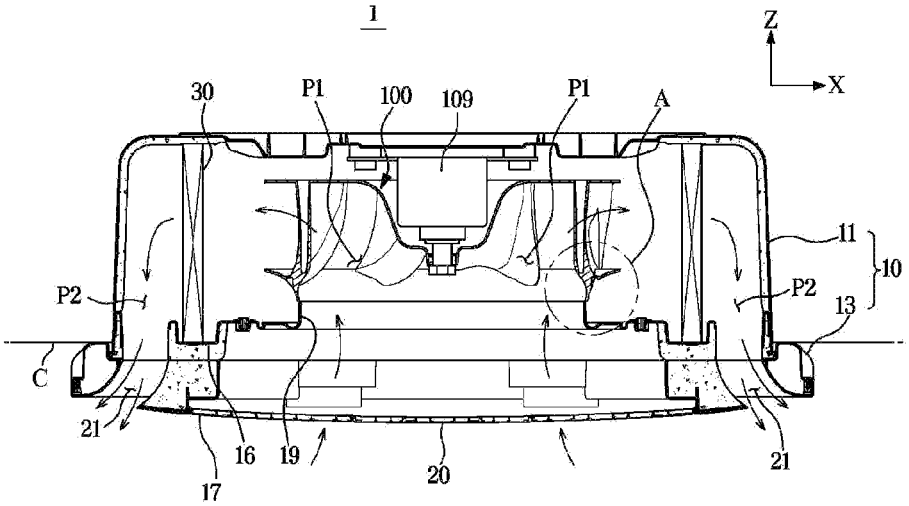
FIG. 2 is a side cross-sectional view of the air conditioner shown in FIG. 1.

Referring to FIGS. 1 and 2, an air conditioner 1 according to one embodiment of the present disclosure may be installed on a ceiling C. At least a portion of the air conditioner 1 may be embedded in the ceiling C.

The air conditioner 1 may include a housing 10 including a suction port 20 and a discharge port 21, a heat exchanger 30 provided inside the housing 10, and a fan 100 configured to move air.

The housing 10 may have a rectangular box shape that is open downward to accommodate components of the air conditioner 1 therein. The housing 10 may include an upper housing 11 arranged inside the ceiling C and a lower housing 13 coupled under the upper housing 11.

The suction port 20 through which air is introduced may be formed at a center of the lower housing 13, and the discharge port 21 through which air is discharged may be formed on an outside of a circumference of the suction port 20. An inlet flow path P1 through which air introduced through the suction port 20 flows may be provided between the suction port 20 and the fan 100, and an outlet flow path P2 through which air discharged by the fan 100 flows may be provided between the fan 100 and the discharge port 21.

The discharge port 21 may be formed adjacent to each edge of the lower housing 13 so as to correspond to a periphery of the lower housing 13. Four discharge ports 21 may be formed. That is, two discharge ports 21 may be formed in the X-axis direction and two discharge ports 21 may be formed in in the Y-axis direction. The four discharge ports 21 are arranged to discharge air to all directions of an indoor space, respectively. With this structure, the air conditioner 1 may suction air from the lower side, cool or heat the suctioned air, and then discharge the cooled or heated air to the lower side again.

A grille 17 may be coupled to a lower surface of the lower housing 13 to filter out dust from air introduced into the suction port 20.

The housing 10 may include an inlet guide 19. The inlet guide 19 may be provided to guide air introduced through the suction port 20 to the fan 100.

The heat exchanger 30 may be formed in a square ring shape and arranged on the outer side of the fan 100 inside the housing 10. The heat exchanger 30 is not limited to the square ring shape, and may be provided in various shapes such as a circular shape, an elliptical shape, or a polygonal shape.

The heat exchanger 30 may be placed on a drain tray 16, and condensed water generated in the heat exchanger 30 may be collected in the drain tray 16. The drain tray 16 may be formed in a shape in accordance with the shape of the heat exchanger 30. That is, when the heat exchanger 30 has a square ring shape, the drain tray 16 may also have a square ring shape, and when the heat exchanger 30 has a circular shape, the drain tray 16 may also have a circular shape.

The fan 100 may be arranged approximately at the center of the housing 10. The fan 100 may be located inside the heat exchanger 30. The fan 100 may be a centrifugal fan that suctions air in an axial direction and discharges the suctioned air in a radial direction. A fan motor 109 configured to drive the fan 100 may be arranged in the air conditioner 1.

With the configuration, the air conditioner 1 may suction air from an indoor space to cool the suctioned air and then discharge the cooled air to the indoor space, or suction air from an indoor space to heat the suctioned air and then discharge the heated air to the indoor space.

Figure 3:
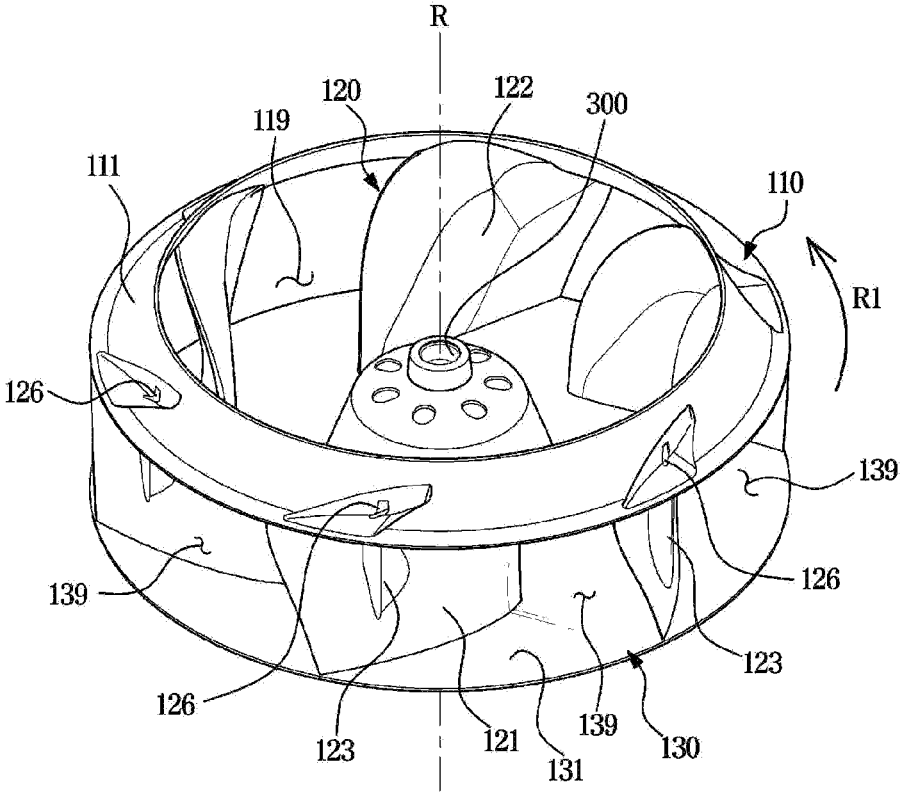
FIG. 3 is a perspective view of a fan according to one embodiment of the present disclosure.
Figure 4:
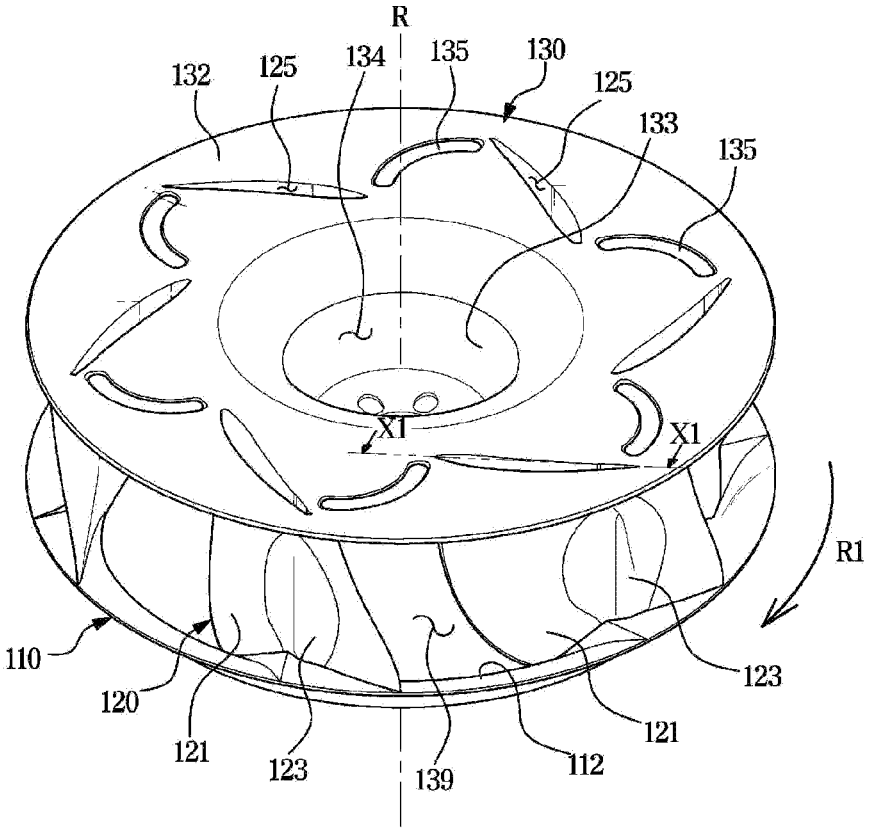
FIG. 4 is a perspective view of the fan according to one embodiment of the present disclosure when viewed from a direction different from that of FIG. 3.
Figure 5:
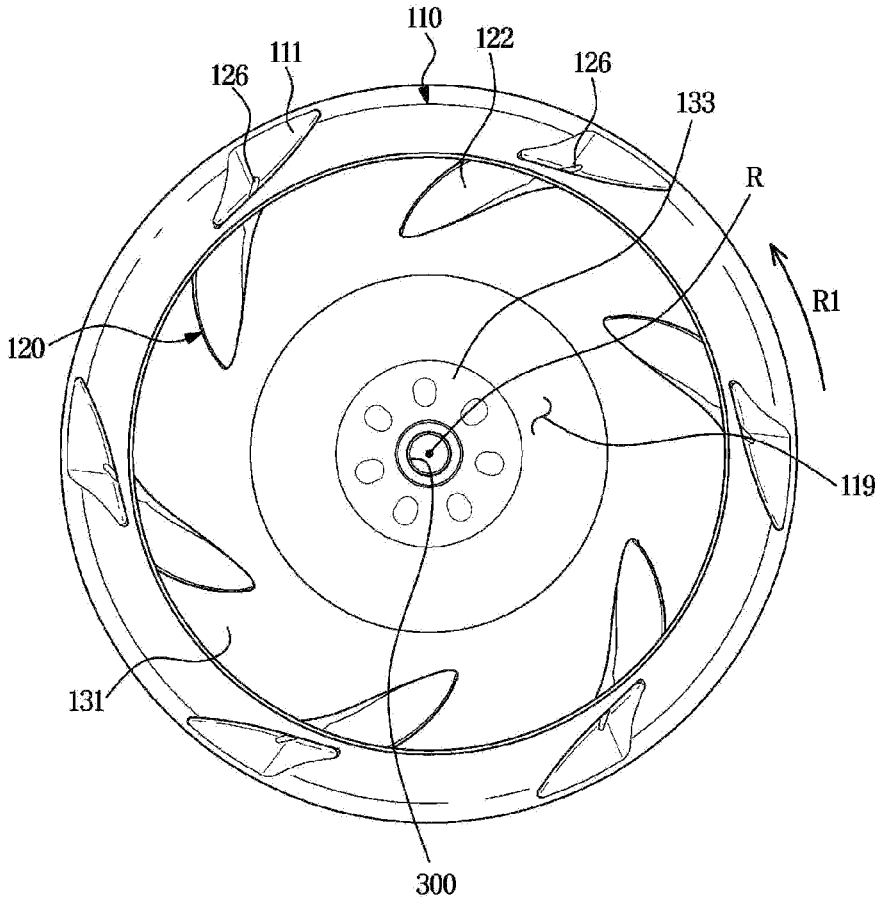
FIG. 5 is a front view of the fan according to one embodiment of the present disclosure.
Figure 6:
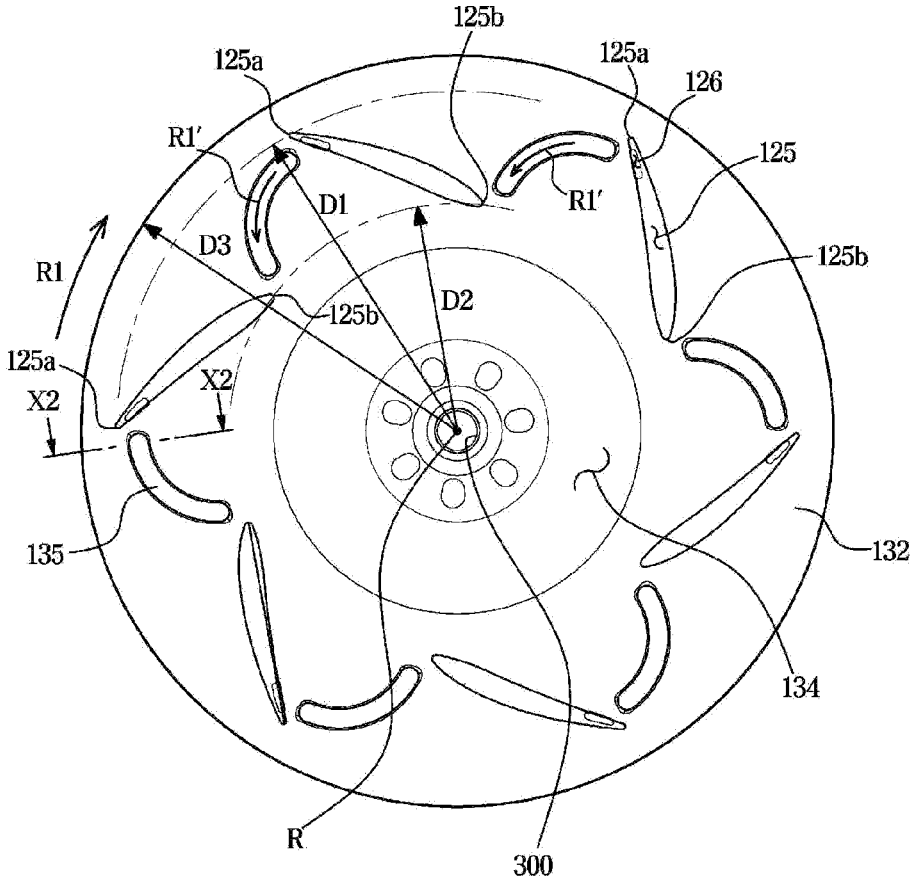
FIG. 6 is a rear view of the fan according to one embodiment of the present disclosure.
Figure 7:
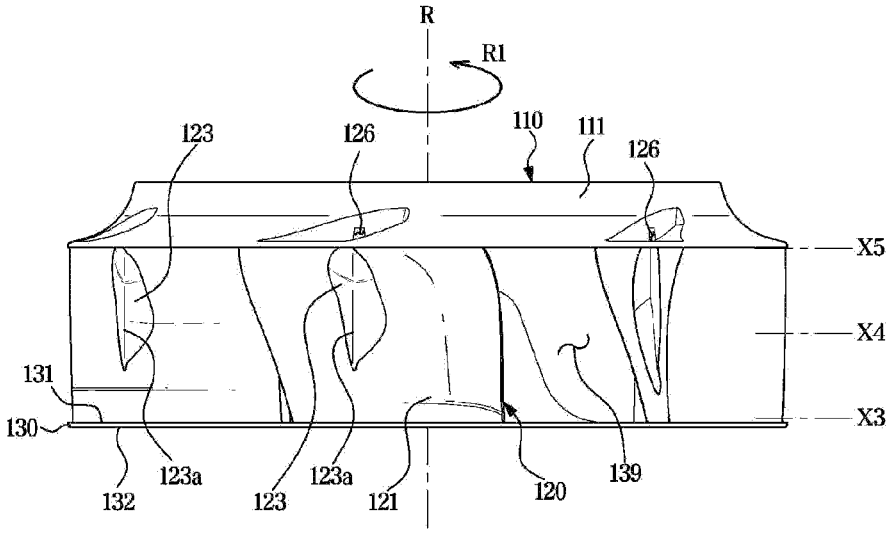
FIG. 7 is a side view of the fan according to one embodiment of the present disclosure.
Figure 8:
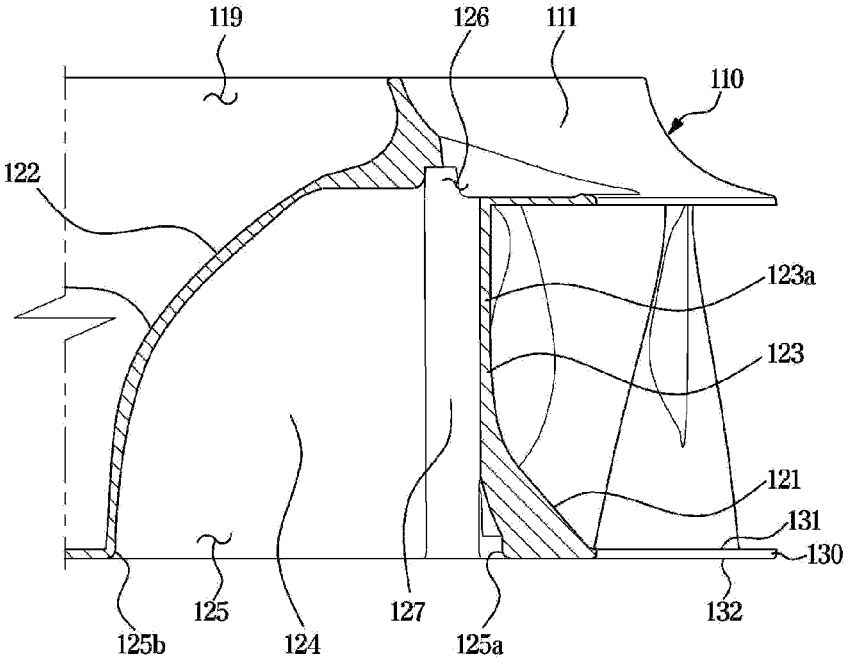
FIG. 8 is a cross-sectional view taken along line X1-X1 of FIG. 4.

FIG. 3 is a perspective view of a fan according to one embodiment of the present disclosure. FIG. 4 is a perspective view of the fan according to one embodiment of the present disclosure when viewed from a direction different from that of FIG. 3. FIG. 5 is a front view of the fan according to one embodiment of the present disclosure. FIG. 6 is a rear view of the fan according to one embodiment of the present disclosure. FIG. 7 is a side view of the fan according to one embodiment of the present disclosure. FIG. 8 is a cross-sectional view taken along line X1-X1 of FIG. 4.

The fan 100 according to one embodiment of the present disclosure may be installed in the fan motor 109 (refer to FIG. 2) and rotate in a predetermined rotation direction R1 around a rotation axis R. The fan 100 may be used as a part of a blowing mechanism in an indoor unit of a ceiling-mounted air conditioner.

The fan 100 may include an inlet 110, a blade 120, and a base 130. The inlet 110, the blade 120, and the base 130 may be integrally molded with each other. The fan 100 may be integrally injection molded. The rotation direction R1 of the base 130 coincides with a rotation direction R1 of the fan 100.

The inlet 110 may be formed in a substantially circular shape. The inlet 110 may have a donut shape with an open center. The inlet 110 may form a fan inlet 119. Air may be introduced into the fan 100 through the fan inlet 119. The inlet 110 has a shape capable of guiding air introduced through the fan inlet 119 to be discharged through a fan outlet 139. The inlet 110 may have a shape that spreads outward along a radial direction toward an upper side.

The base 130 may have a substantially disc shape. The base 130 may include a fan motor accommodating member 134 positioned substantially in the center. Particularly, the base 130 may include a base central member 133 arranged on a center of the base and protruding toward the inlet 110. The base central member 133 may be provided in the shape of a substantially hollow hemisphere. The fan motor accommodating member 134 may be formed in a region, which corresponds to the base central member 133, of a base upper surface 132.

A bearing 300, into which a motor shaft of the fan motor 109 is inserted, may be insert-molded at the center of the base central member 133.

The fan motor accommodating member 134 may be formed to accommodate the fan motor 109. The fan motor accommodating member 134 may extend along the rotation axis direction of the fan 100.

The fan outlet 139 may be formed between the inlet 110 and the base 130. The fan outlet 139 may be formed along the circumference of the fan 100.

The blade 120 may be positioned between the inlet 110 and the base 130. The blade 120 may extend from the base 130 to the inlet 110. The blade 120 may be provided in plurality so as to be spaced apart at predetermined intervals along the circumference of the fan 100. The blade 120 may include a first surface 121 on which positive pressure is generated as the fan 100 rotates, and a second surface 122 on which negative pressure is generated as the fan 100 rotates. The first surface 121 may be located in the rotation direction R1 of the base 130. The second surface 122 may be positioned in a direction opposite to the rotation direction R1 of the base 130. In other words, the blade 120 may include the first surface 121 facing outward in the radial direction and the second surface 122 facing inward in the radial direction.

As the fan 100 rotates along the rotation direction R1 around the rotation axis R by the fan motor 109, the fan 100 may suction air by the negative pressure formed on the second surface 122, and then discharge the air by the positive pressure formed on the first surface 121.

Referring to FIGS. 3 to 8, the blade 120 may further include a hollow 124 and a curved portion 123 formed on the first surface 121. The hollow 124 may be formed inside the blade 120. The curved portion 123 may protrude from the first surface 121. One side of the hollow 124 may be arranged in a region corresponding to the curved portion 123.

By the hollow 124, it is possible to reduce a weight of the blade 120 so as to improve a rotational efficiency of the fan 100. However, when only one end of a core inserted into a molding space of the blade 120 to form the hollow 124 is supported, the core may be inclined during a high-pressure resin injection process.

In order to prevent the inclination of the core, the fan may be injection molded by injecting a resin to a mold which forms the base upper surface 132, and a mold in a state in which one end of a cavity core, which protrudes from the mold and is inserted into a molding space of the blade 120 to form the hollow 124, is fixed to a mold that forms an inlet lower surface 111.

Referring to FIG. 8, the hollow 124 may be provided in a shape in which a width of the hollow 124 is gradually reduced as the hollow 124 starts from the base upper surface 132 and becomes near to the inlet 110. The hollow 124 may be provided in a substantially fin shape. The hollow 124 may correspond to the shape of the cavity core (refer to FIG. 13) inserted into the molding space of the blade 120 to form the hollow 124.

The hollow 124 may include a first opening 125 and a second opening 126. The first opening 125 may be formed on the base upper surface 132 and may be arranged at one end of the hollow 124. Based on an arrangement direction of FIG. 2, the first opening 125 may be formed at an upper end of the hollow 124. The second opening 126 may be formed on the inlet lower surface 111 and may be formed at the other end of the hollow 124. Based on the arrangement direction of FIG. 2, the first opening 125 may be formed at a lower end of the hollow 124.

The first opening 125 may have a larger area than the second opening 126. An area of a cross section, which is perpendicular to the rotation axis, of the hollow 124 may be gradually reduced from the first opening 125 to the second opening 126. Because the area of the second opening 126 formed on the inlet lower surface 111 is significantly less than the area of the first opening 125 formed on the base upper surface 132, it is possible to effectively achieve the weight loss of the blade 120 and at the same time, it is possible to prevent pressure loss caused by the hollow 124.

Referring to FIG. 6, because the first opening 125 is formed to have a large area than the second opening 126, the second opening 126 may overlap the inside of the first opening 125 on one end of the first opening 125 when viewed from the base upper surface 132.

Referring to FIG. 6, the shape of the first opening 125 may be provided as an airfoil, which is a typical cross-sectional shape of an aircraft wing.

One end 125*a* of the first opening may be arranged on the outside of the base upper surface 132, and the other end 125*b* of the first opening may be arranged on the inside of the base upper surface 132.

Particularly, the one end 125*a* of the first opening may be arranged on the outside of the base upper surface 132 along a circumference having an outer radius D1. The outer radius D1 may be less than a radius D3 of the base edge. The blade 120 may be provided in plurality to be spaced apart at predetermined intervals along the circumference of the fan 100. The first opening 125, that is, the one end 125*a* of the first opening may be provided in plurality to be spaced apart at predetermined intervals along the circumference having the outer radius D1.

The other end 125*b* of the first opening may be arranged on the inside of the base upper surface 132 along a circumference having an inner radius D2. The inner radius D2 may be less than the outer radius D1. The blade 120 may be provided in plurality to be spaced apart at predetermined intervals along the circumference of the fan 100. The first opening 125, that is, the other end 125*b* of the first opening may be provided in plurality to be spaced apart at predetermined intervals along the circumference having the inner radius D2.

The relationship between the outer radius D1, the inner radius D2, and the radius D3 of the base edge may be set as follows.

$$\text{Outer radius D1/radius of base edge D3} < 0.92$$

$$\text{Inner radius D2/radius of base edge D3} > 0.58$$

Referring to FIG. 6, the one end 125*a* of the first opening may be arranged to follow the other end 125*b* of the first opening based on the rotation direction R1 of the base 130. In other words, when it is assumed that a line corresponds to the radius of the base upper surface 132, in response to the rotation of the base 130 in the rotation direction R1, the other end 125*b* of the first opening may firstly pass through the line and then the one end 125*a* of the first opening may pass through the line later.

Referring to FIG. 8, a portion of the hollow 124 may be provided as a guide hollow 127 extending from the second opening 126 toward one end of the first opening 125. The guide hollow 127 may be provided in a flat bar shape extending from the first opening 125 toward one end of the second opening 126.

One side of the hollow 124 may be arranged in a region corresponding to the curved portion 123. At this time, the guide hollow 127 may be arranged on one side of the hollow 124. That is, the guide hollow 127 may be arranged in a region, which corresponds to the curved portion 123, of the inside of the blade 120.

Referring to FIGS. 4 and 6, a groove 135 having a predetermined shape may be formed on the base upper surface 132. The groove 135 may be formed between two adjacent first openings 125 among the plurality of first openings 125. The groove 135 may be formed between two adjacent first openings 125 among the plurality of first openings 125 while being formed not to overlap the first opening 125 with respect to the radial direction of the base 130.

The groove 135 may extend from one end 125*a* of one first opening of the two adjacent first openings 125 toward the other end 125*b* of other first opening of the two adjacent first openings 125. Referring to FIG. 6, an extending direction R1' of the groove 135 may be provided in a direction opposite to the rotation direction R1 of the base. The shape of the groove 135 may be formed in a short arc shape.

A relationship between a thickness of the base 130 and a depth 135*a* of the groove will be described later.

Figure 9:
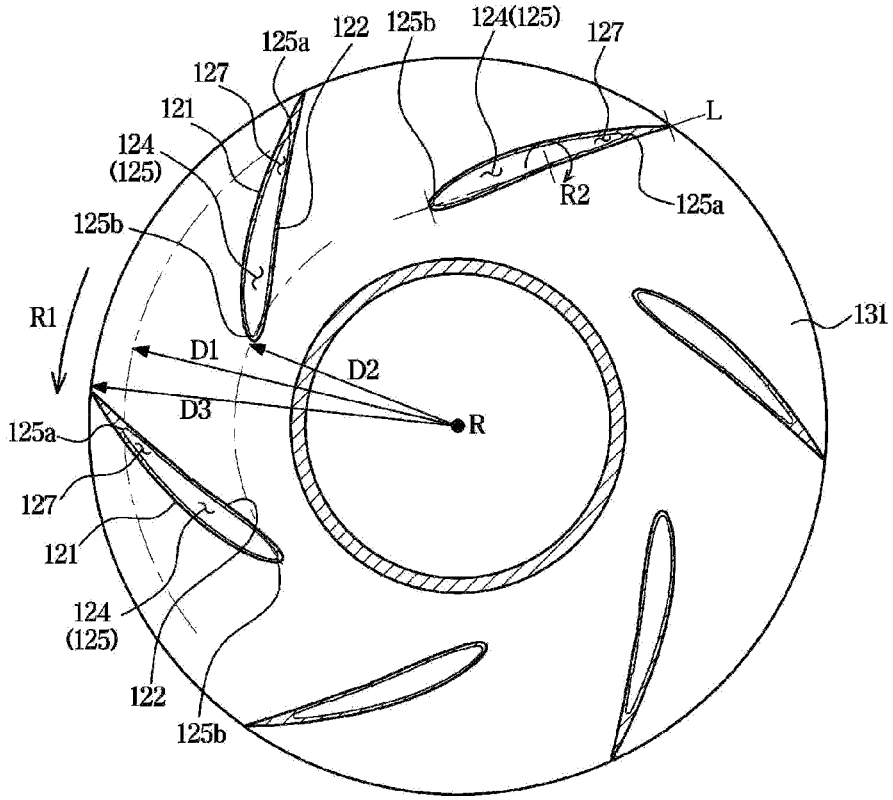
FIG. 9 is a cross-sectional view taken along line X3-X3 of FIG. 7.
Figure 10:
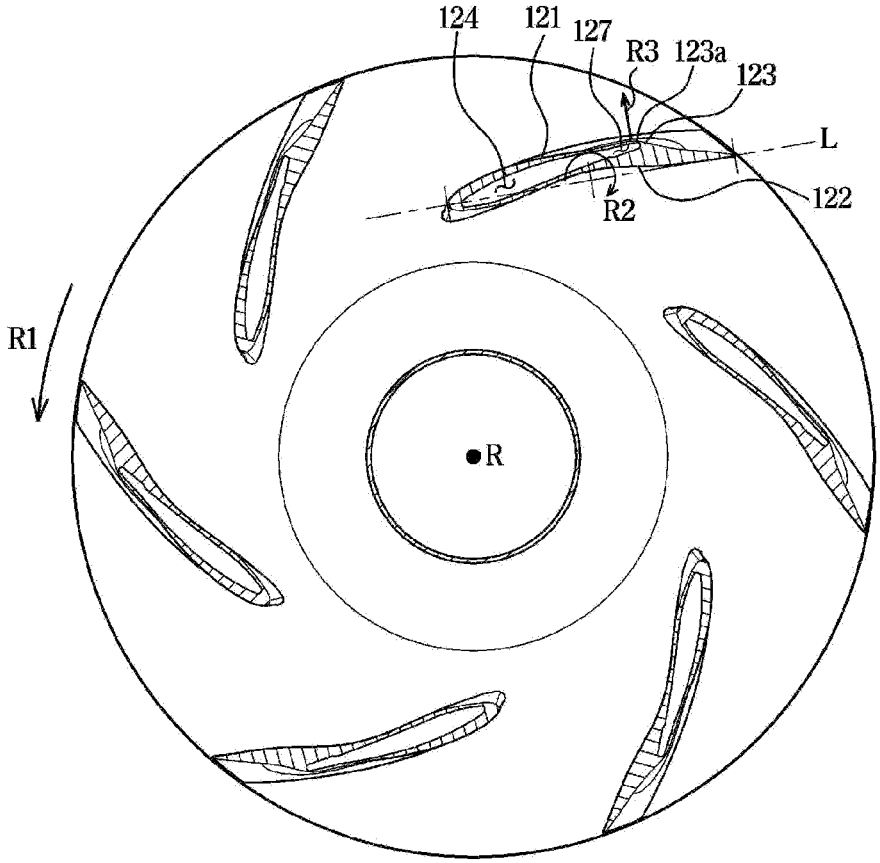
FIG. 10 is a cross-sectional view taken along line X4-X4 of FIG. 7.
Figure 11:
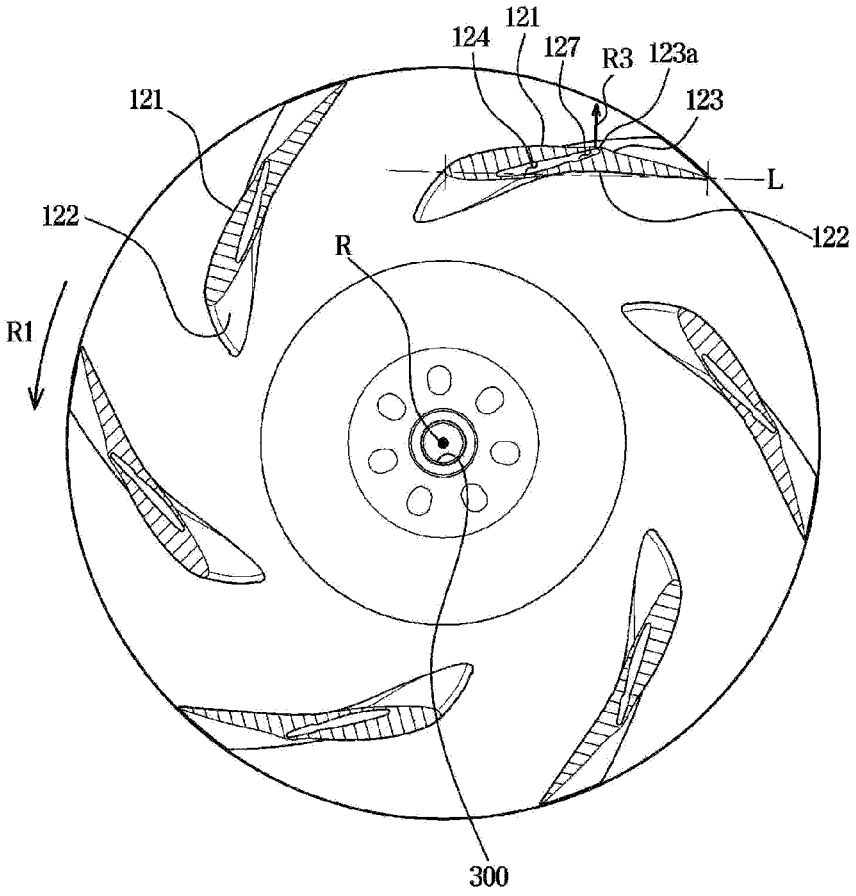
FIG. 11 is a cross-sectional view taken along line X5-X5 of FIG. 7.

FIG. 8 is a cross-sectional view taken along line X1-X1 of FIG. 4. FIG. 9 is a cross-sectional view taken along line X3-X3 of FIG. 7. FIG. 10 is a cross-sectional view taken along line X4-X4 of FIG. 7. FIG. 11 is a cross-sectional view taken along line X5-X5 of FIG. 7.

Hereinafter the curved portion 123, a relationship between the curved portion 123 and the first surface 121 of the blade 120, and a relationship between the curved portion 123 and the hollow 124 will be described in detail with reference to FIGS. 8 to 12.

FIG. 9 illustrates a cross section of the blade 120 adjacent to the base 130. FIG. 11 illustrates a cross section of the blade 120 adjacent to the inlet 110, particularly, a cross section of the blade 120 adjacent to the inlet upper surface 112. FIG. 10 illustrates a cross section of the blade 120 located between the cross section of the blade 120 of FIG. 9 and the cross section of the blade 120 of FIG. 11. It is assumed that the cross section of the blade 120 is formed to be perpendicular to the rotation axis R.

Referring to FIGS. 9 to 11, the cross section of the blade 120 may be provided as an airfoil, which is a typical cross-sectional shape of an aircraft wing.

It is possible to assume a connection line L connecting one end and the other end of the cross section of the blade 120. The connection line L may correspond to a chord of the airfoil. Cross sections of the plurality of blades 120 may be formed along the rotation axis R. Therefore, it is possible to assume a plurality of connection lines L along the rotation axis R. A connection line L relatively adjacent to the base 130 may be defined as a first connection line, and a connection line L relatively adjacent to the inlet 110 may be defined as a second connection line.

The cross section of the hollow 124 shown in FIG. 9 may be provided in a shape corresponding to the cross section of the blade 120. In other words, a cross section of the hollow 124 adjacent to the first opening 125 and perpendicular to the rotation axis R may have a shape corresponding to a cross section of the blade 120 adjacent to the first opening 125 and perpendicular to the rotation axis R. FIG. 9 illustrates a cross section of the blade 120 corresponding to a base lower surface 131 and thus it can be seen that the cross section of the hollow 124 of FIG. 9 corresponds to the shape of the first opening 125.

Referring to FIGS. 9 and 10, as the connection line L approaches the inlet 110 from the base 130, the connection line L may rotate in an opposite direction R2 to the rotation direction R1 of the base 130. That is, when a direction opposite to the rotation direction R1 of the base 130 is defined as a first direction R2, the blade 120 may be formed in such a way that the first connection line L is inclined toward the first direction R2 with respect to the second connection line.

With the structure, a point, at which the air introduced through the fan inlet 119 is separated from the surface of the blade 120, may be moved toward the base 130, thereby minimizing the intensity of the turbulence and reducing the noise.

Referring to FIGS. 9 to 11, when the connection line L is inclined in the opposite direction to the rotation direction R1 of the base 130 as the base 130 approaches the inlet 110, the first surface 121 of the blade 120 may be twisted in the direction opposite to the rotation direction R1 of the base 130 along the connection line L. In the process of twisting the first surface 121 in the direction opposite to the rotation direction R1 of the base 130, that is, in the first direction R2, the first surface 121 may overlap the hollow 124.

Accordingly, the curved portion 123 protruding from the first surface 121 may be formed in an overlapping region between the first surface 121 and the hollow 124. Because the curved portion 123 is formed, it is possible to prevent the hollow 124 from being exposed to the outside through the first surface 121 during the injection molding process of the fan 100. A protruding direction of the curved portion 123 may be defined as a second direction R3. The second direction R3 may be provided in an opposite direction to the first direction R2. The curved portion 123 may protrude in the second direction R3.

Referring to FIGS. 3 to 11, one side of the hollow 124 may be arranged in a region corresponding to the curved portion 123. At this time, the guide hollow 127 may be arranged on one side of the hollow 124. That is, the guide hollow 127 may be arranged in a region, which corresponds to the curved portion 123, of the inside of the blade 120. A curved line 123*a* corresponding to one side of the hollow 124 may be formed in the curved portion 123. Particularly, the curved line 123*a* may be formed along the guide hollow 127 arranged on one side of the hollow 124. The curved line 123*a* may start from a region adjacent to the second opening 126 toward the base 130 in the direction of the rotation axis R.

Referring to FIG. 11, a maximum protruding amount of the curved portion 123 may be provided as follows.

length of perpendicular from curved line 123*a* to connection line L/length of connection line L≥0.1

Figure 12:
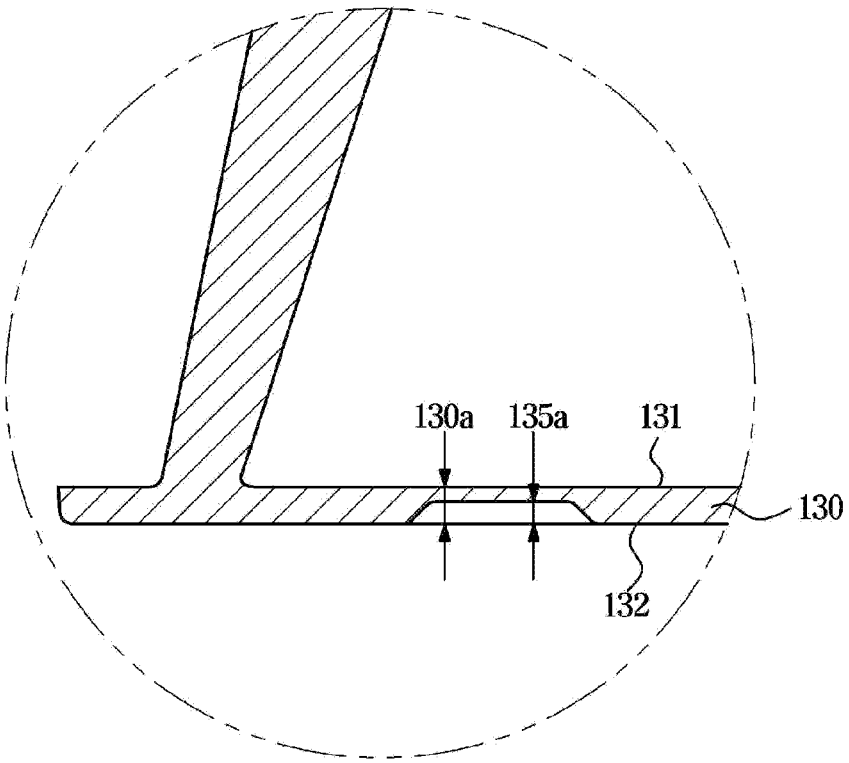
FIG. 12 is a cross-sectional view taken along line X2-X2 of FIG. 6.

FIG. 12 is a cross-sectional view taken along line X2-X2 of FIG. 6.

A specific structure of the groove 135 is as described above. The relationship between a thickness 130*a* of the base 130 and a depth 135*a* of the groove may be provided as follows.

Depth 135*a* of groove/thickness 130*a* of base>0.6

Figure 13:
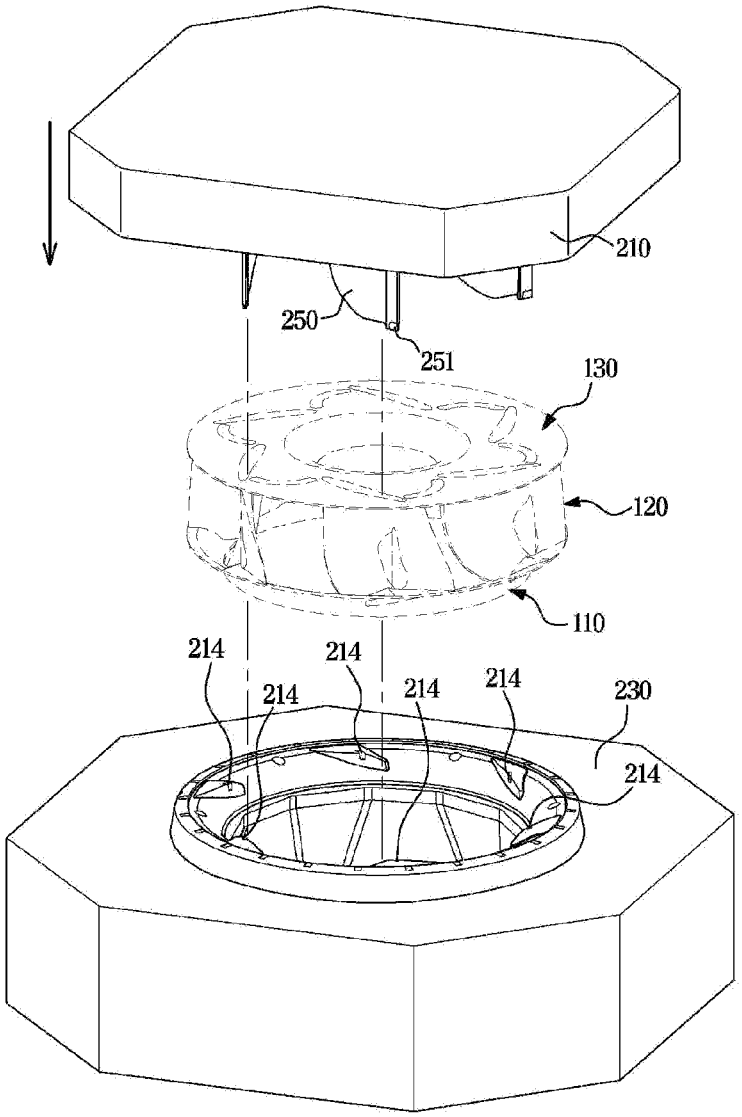
FIG. 13 is a perspective view of a first mold and a third mold of a manufacturing apparatus according to one embodiment of the present disclosure.
Figure 14:
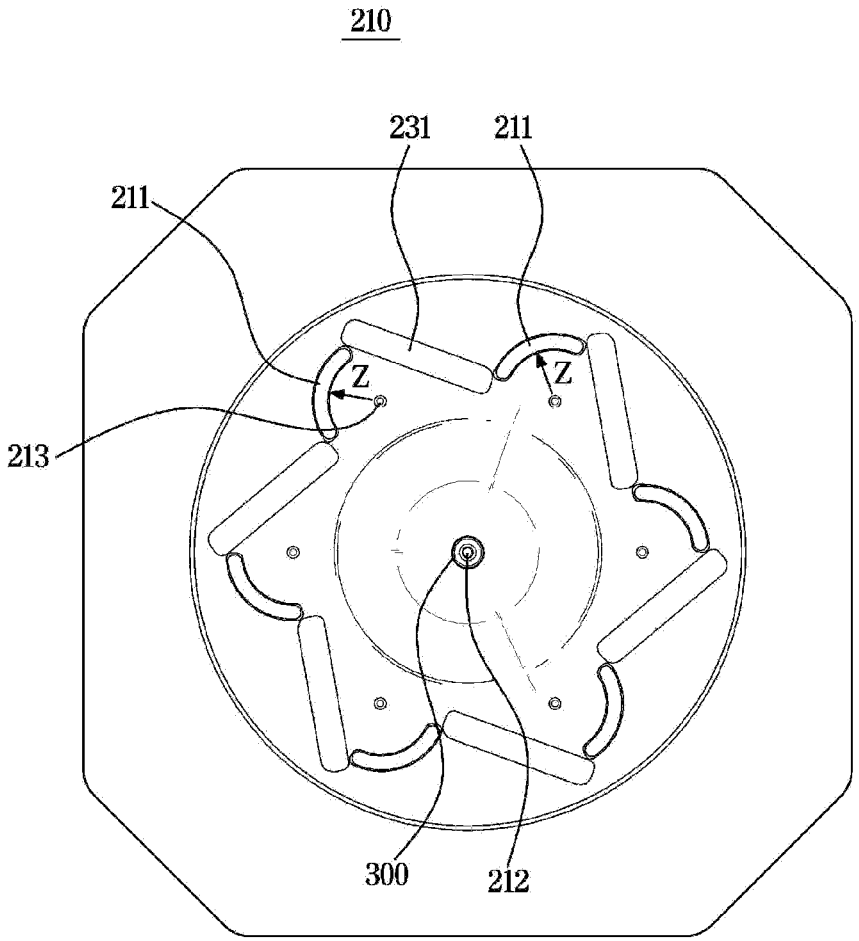
FIG. 14 is a front view of the first mold of the manufacturing apparatus according to one embodiment of the present disclosure.
Figure 15:
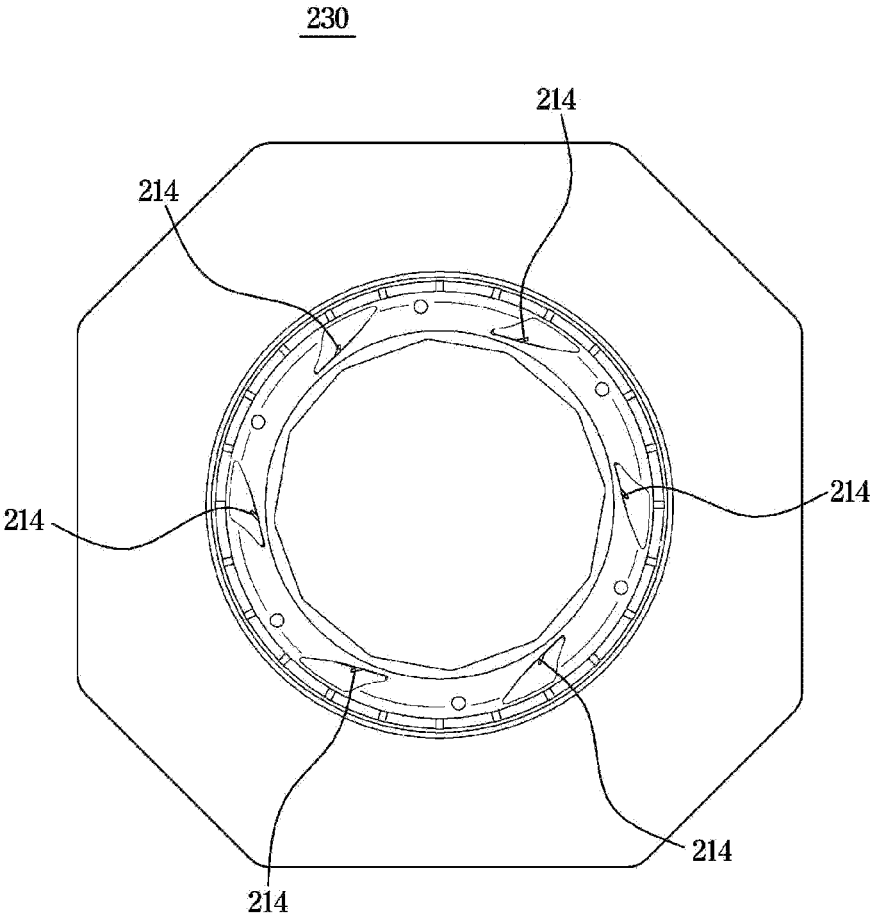
FIG. 15 is a front view of the third mold of the manufacturing apparatus according to one embodiment of the present disclosure.
Figure 16:
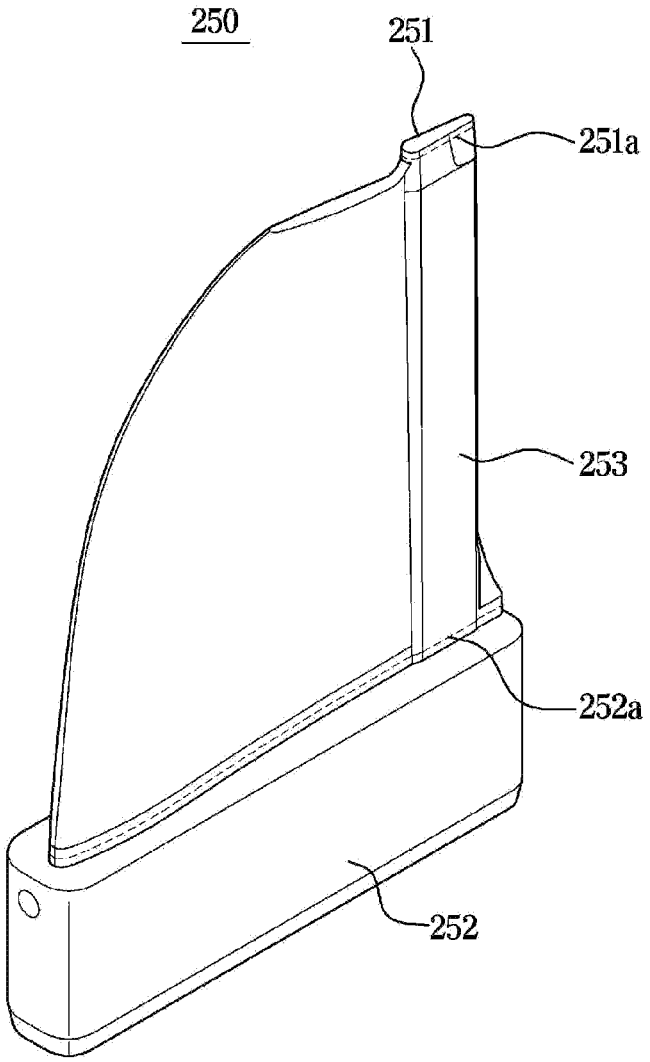
FIG. 16 is a perspective view of a cavity core of the manufacturing apparatus according to one embodiment of the present disclosure.

FIG. 13 is a perspective view of a first mold and a third mold of a manufacturing apparatus according to one embodiment of the present disclosure. FIG. 14 is a front view of the first mold of the manufacturing apparatus according to one embodiment of the present disclosure. FIG. 15 is a front view of the third mold of the manufacturing apparatus according to one embodiment of the present disclosure. FIG. 16 is a perspective view of a cavity core of the manufacturing apparatus according to one embodiment of the present disclosure.

A manufacturing apparatus according to one embodiment of the present disclosure may be provided to allow the fan 100 including the base 130, the inlet 110, and the blade 120 to be integrally injection-molded.

Particularly, by the manufacturing apparatus, the fan 100, which includes the base 130 rotatably provided around the rotation axis R, the inlet 110 including the fan inlet 119 formed in the central portion thereof and spaced apart from one surface of the base 130, and the blade 120 arranged between the base 130 and the inlet 110 and including the hollow 124 formed therein, may be integrally injection-molded.

The manufacturing apparatus according to one embodiment of the present disclosure may include a first mold 210 to a fourth mold 240.

The first mold 210 may be provided to form the base upper surface 132.

The second mold 220 may be provided to form an inner part of the blade 120. Particularly, the second mold 220 may be provided to form an upper portion of the second surface 122 of the blade 120. The second mold 220 may be provided to form the base central member 133 of the base lower surface 131.

The second mold 220 may be provided to form the lower surface of the inlet 110.

The second mold 220 and the third mold 230 may be arranged below the first mold 210. The first mold 210 may be relatively moved in the vertical direction with respect to at least one of the second mold 220 and the third mold 230. Alternatively, at least one of the second mold 220 and the third mold 230 may be relatively moved in the vertical direction with respect to the first mold 210.

The fourth mold may be provided to form the blade 120, the remaining lower surface in which the base central member 133 is expected from the base lower surface 131, and the upper surface of the inlet 110. Particularly, the fourth mold may be provided to form the first surface 121 of the blade 120 and a lower portion of the second surface 122 of the blade. The fourth mold may include a plurality of cores 241 (refer to FIG. 20).

A molding space into which a resin is injected may be formed by coupling the first mold 210 to the fourth mold. A resin may be injected from the side of the first mold 210 toward the molding space. The resin injected into the molding space may be cooled to form the fan 100. The molding space may be provided in a shape corresponding to the fan 100.

Referring to FIG. 13, the blade 120 may be formed by injecting a resin into the molding space and into a vicinity of the cavity core 250. The cavity core 250 may be provided to correspond to the shape of the hollow 124.

Referring to FIGS. 13 to 16, the first mold 210 may be moved toward the third mold 230. When the first mold 210 is moved relative to the third mold 230 in the vertical direction and then the first mold 210 reaches a certain distance from the third mold 230, one end 251 of the cavity core 250 protruding from the first mold 210 may be fixed to the third mold 230.

The other end 252 of the cavity core may be inserted and fixed into a core mounting member 231 formed in the first mold 210. In the third mold, a core fixer 214 may be formed at a position corresponding to the one end 251 of the cavity core. The fan may be injection molded by injecting a resin into the mold in a state in which the one end 251 of the cavity core is fixed to the third mold 230.

A vicinity of the cavity core 250 may be filled with a resin, and the first opening 125 of the hollow 124 may be formed along a first opening molding position 252*a* of the cavity core 250. A vicinity of the one end 251 of the cavity core may be filled with a resin. A portion, which is in contact with the third mold 230, in a second opening molding position 251*a* corresponding to the circumference of one end 251 of the cavity core is not filled with a resin. That is, the second opening 126 may be formed at a portion in contact with the third mold 230 among the second opening molding positions 251*a*.

In other words, a resin may be injected around a portion, which is adjacent to the first mold 210, of the cavity core 250, and the first opening 125 formed on the base upper surface 132 and arranged at one end of the hollow 124 may be injection molded. A resin may be injected around the one end 251 of the cavity core fixed to the third mold 230, and the second opening 126 formed on the inlet lower surface 111 and formed on the other end of the hollow 124 may be injection molded.

Referring to FIG. 14, a resin may be injected into the molding space through a resin injection port 213 from the side of the first mold 210 so as to allow the resin to spread from the inside to the outside of the base upper surface 132.

The first mold 210 may further include a protrusion 211 formed on the first mold 210. The protrusion 211 may be formed between two adjacent cavity cores among the plurality of cavity cores 250. The protrusion 211 may limit a flow of the resin flowing in a direction Z that is from the resin injection port 213 toward between two adjacent cavity cores. By the protrusion 211, the groove 135 may be injection molded on the base lower surface 131. A shape of the protrusion 211 may correspond to the shape of the groove 135.

By limiting the flow of the resin flowing in the direction Z from the resin injection port 213 toward between the two adjacent cavity cores, it is possible to prevent a phenomenon in which the molding space is not sufficiently filled with the resin due to air that is trapped in the center of the first surface 121 of the blade 120.

Figure 17:
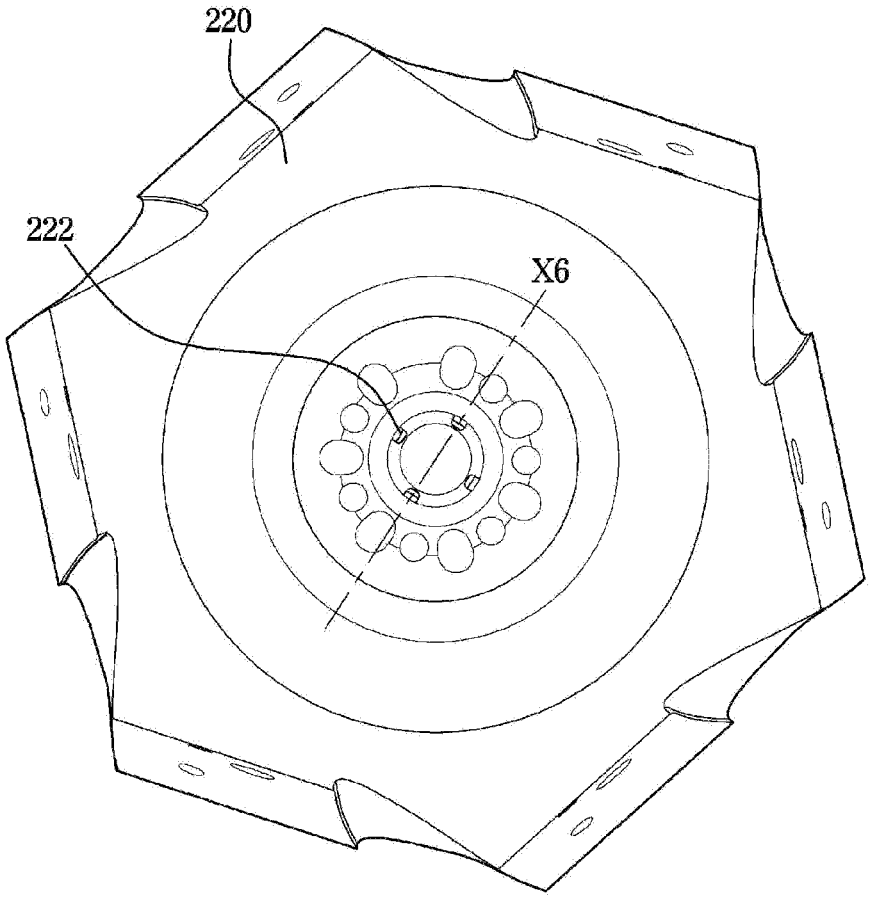
FIG. 17 is a front view of a second mold of the manufacturing apparatus according to one embodiment of the present disclosure.
Figure 18:
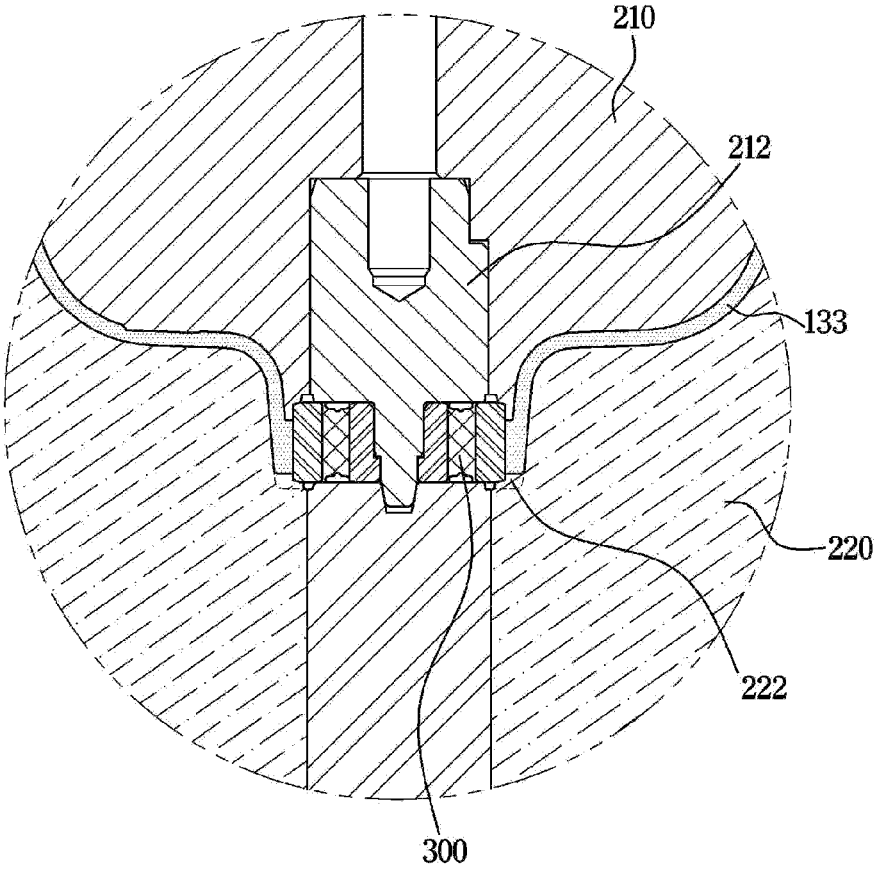
FIG. 18 is an enlarged view of a region Y of FIG. 13.

FIG. 17 is a front view of a second mold of the manufacturing apparatus according to one embodiment of the present disclosure. FIG. 18 is an enlarged view of a region Y of FIG. 13.

Referring to FIGS. 17 and 18, the first mold 210 may further include a bearing fixer 212 provided at the center of the first mold 210. The second mold 220 may include a plurality of support protrusions 222 provided at positions corresponding to the bearing fixer 212 of the first mold 210 so as to support the bearing. After the bearing 300 is inserted into the bearing fixer 212, the first mold 210 to the fourth mold may be coupled so as to form the molding space. When the first mold 210 to the fourth mold are coupled to form the molding space, the bearing 300 may be supported by the plurality of support protrusions 222. In a state in which the bearing 300 is supported by the plurality of support protrusions 222, a resin may be injected into the molding space and then the fan may be injection molded. The fan 100 in which the bearing 300 is inserted into the base central member 133 may be injection molded. With the structure, it is possible to more stably support the bearing within the molding space, and it is possible to prevent the eccentricity of the injection-molded fan 100.

Figure 19:
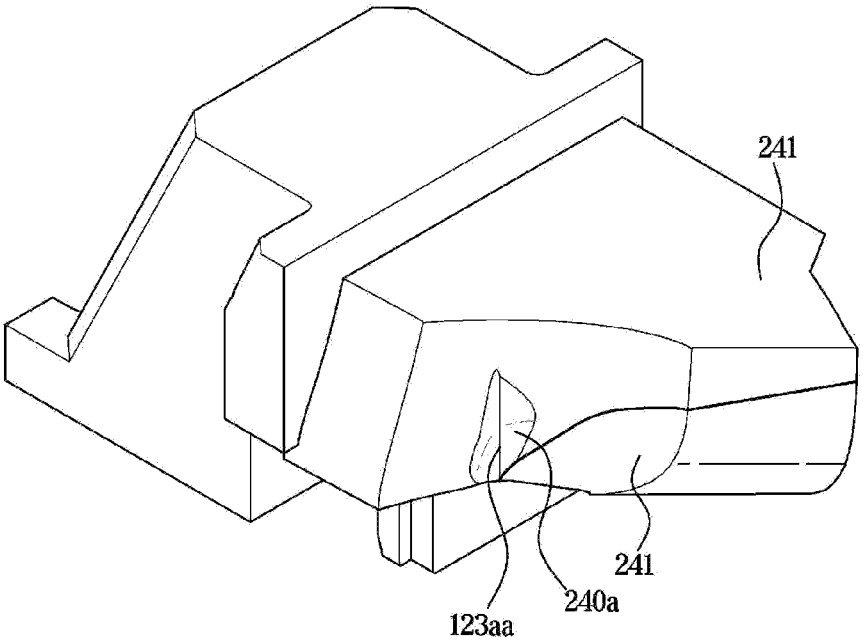
FIG. 19 is a perspective view of a fourth mold and a depression of the manufacturing apparatus according to one embodiment of the present disclosure.

FIG. 19 is a perspective view of a fourth mold and a depression of the manufacturing apparatus according to one embodiment of the present disclosure.

A structure in which the blade 120 includes the first surface 121 located in the rotation direction R1 of the base 130, the second surface 122 located in the opposite direction to the rotation direction R1 of the base 130, and the curved portion 123 protruding from the first surface 121 may be the same as the above-mentioned description. When the first mold 210 to the fourth mold are coupled, the fourth mold may further include a depression 240*a* at a position corresponding to the cavity core 250.

Particularly, one of the plurality of cores 241 may be provided to form an upper portion of the first surface 121 of the blade 120, and other of the plurality of cores 241 may be provided to form the lower portion of the first surface 121 of the blade 120. That is, a pair of slide cores 241 among the plurality of cores 241 may form the first surface 121.

In the pair of cores 241 provided to form the first surface 121, the depression 240*a* may be formed at a position corresponding to the cavity core 250. A resin may be injected between the cavity core 250 and the depression 240*a* to form the curved portion 123. A depression line 123*aa* corresponding to the curved line 123*a* may be formed in the depression 240*a*.

While the present disclosure has been particularly described with reference to exemplary embodiments, it should be understood by those of skilled in the art that various changes in form and details may be made without departing from the spirit and scope of the present disclosure.

What is claimed is:

1. A fan comprising:

a base to be rotated with respect to a rotation axis;

an inlet having an opening formed in a center thereof, the inlet spaced apart from the base with respect to a rotation axis direction; and a blade arranged between the base and the inlet, wherein the blade includes:

a first surface facing outward with respect to a radial direction of the fan;

a second surface facing inward with respect to the radial direction of the fan;

a curved portion protruding from the first surface; and a hollow formed inside the blade, the hollow comprising:

a first opening formed on an outer surface of the base and arranged at one end of the hollow; and a second opening formed on an outer surface of the inlet and formed at an other end of the hollow.

2. The fan of claim 1, wherein an area of a cross section of the hollow perpendicular to the rotation axis is gradually reduced from the first opening to the second opening.

3. The fan of claim 1, wherein a cross section of the hollow adjacent to the first opening and perpendicular to the rotation axis has a shape corresponding to a shape of a cross section of the blade adjacent to the first opening and perpendicular to the rotation axis.

4. The fan of claim 1, wherein a cross section of the blade is disposed as an airfoil, the blade is formed among a connection line which is a chord of the airfoil, connecting one end of a cross section of the blade and an other end of the cross section of the blade, the cross section of the blade is perpendicular to the rotation axis, and the connection line includes a first connection line adjacent to the base is inclined to a first direction, which is opposite to the rotation direction of the base, with respect to a second connection line adjacent to the inlet.

5. The fan of claim 4, wherein a second direction corresponding to a protruding direction of the curved portion is in a direction opposite to the first direction.

6. The fan of claim 1, wherein one end of the first opening is arranged on an outside of the outer surface of the base, an other end of the first opening is arranged on an inside of the outer surface of the base, and the one end of the first opening is to follow the other end of the first opening with respect to a rotation direction of the base, wherein the second opening overlaps the inside of the first opening at one end of the first opening when viewed from the outer surface of the base.

7. The fan of claim 6, wherein the blade, the hollow and the first opening are provided in plurality, wherein the fan further comprises a groove formed on the outer surface of the base and formed between two adjacent first openings among the plurality of first openings.

8. The fan of claim 7, wherein the groove extends from one end of one first opening of the two adjacent first openings toward the other end of the other first opening, and arranged not to overlap the first opening with respect to the radial direction.

9. The fan of claim 6, wherein a portion of the hollow is a guide hollow arranged parallel to the rotation axis and extending from the second opening toward the one end of the first opening.

10. The fan of claim 9, wherein the guide hollow has a flat bar shape extending from the first opening toward one end of the second opening.

11. The fan of claim 5, wherein the guide hollow is arranged in a region, which corresponds to the curved portion, of the inside of the blade.

12. An air conditioner comprising:

a housing;

a heat exchanger arranged inside the housing; and a fan configured to introduce external air into the housing and discharge the introduced air to an outside of the housing, wherein the fan comprises:

an inlet having an opening through which the external air is introduced;

a base on which a fan motor configured to rotate the fan is mounted; and a blade arranged between the base and the inlet, the blade comprising:

a first surface facing outward with respect to a radial direction of the fan;

a second surface facing inward with respect to the radial direction of the fan;

a curved portion protruding from the first surface; and a hollow formed inside the blade, the hollow comprising:

a first opening formed on an outer surface of the base and arranged at one end of the hollow; and a second opening formed on an outer surface of the inlet and formed at an other end of the hollow.

13. The air conditioner of claim 12, wherein wherein the second opening and one side of the hollow are arranged in a region corresponding to the curved portion.

* * * * *